US005738225A

United States Patent [19]

Kim

[11] Patent Number: 5,738,225

[45] Date of Patent: Apr. 14, 1998

[54] DEVICE IN WHICH A BOOKRACK MOVES VERTICALLY AND HORIZONTALLY

[76] Inventor: Bongki Kim, O-yang Daeyon Yangji Apt. 2-407, 1536-12, Daeyon 6 dong, Namku Pusan, Rep. of Korea

[21] Appl. No.: 734,739

[22] Filed: Oct. 21, 1996

[51] Int. Cl.[6] ..... A47F 5/02

[52] U.S. Cl. ..... 211/1.57; 211/121

[58] Field of Search ..... 211/1.57, 1.51, 211/42, 121, 122, 164

[56] References Cited

U.S. PATENT DOCUMENTS

| | | | |
|---|---|---|---|
| 1,785,954 | 12/1930 | Hayes | 211/164 X |
| 3,269,521 | 8/1966 | Briglia | 211/121 X |
| 3,861,519 | 1/1975 | Ware | 211/121 |
| 4,314,647 | 2/1982 | Harris et al. | 211/121 |
| 4,650,264 | 3/1987 | Dahnert | 211/121 X |
| 4,676,560 | 6/1987 | Schmitz et al. | 211/121 X |
| 5,040,689 | 8/1991 | Hull et al. | 211/164 X |

*Primary Examiner*—Alvin C. Chin-Shue
*Assistant Examiner*—Long Dinh Phan
*Attorney, Agent, or Firm*—Notaro & Michalos P.C.

[57] ABSTRACT

A bookrack that moves vertically and horizontally is provided with a chain gear (56) of a reduction motor (55) that turns left or rights by the operation of switches (3, 4). Power is supplied to a rotary wheel (48) to turn an attachment double chain (44). A rotary wheel (40) of a moving body (35) turns motivated by the attachment double chain (44), and a gear (41) connected to the rotary wheel (40) is rotated and engages a rack gear (43). The moving body (35) is thereby made to move in a direction contrary to the attachment double chain (44). A bookrack (80) connected to the moving body (35) is caused to move vertically and horizontally around a right-angled tetragonal track with the moving body (35). The bookrack enables a child, an old or infirm person or a handicapped person to take out or arrange books from a seated position, since the bookrack (80) moves freely and is kept horizontal at all positions as the moving body (35) moves the bookrack (80) horizontally and vertically around the track.

1 Claim, 10 Drawing Sheets

DEVICE IN WHICH A BOOKRACK MOVES VERTICALLY AND HORIZONTALLY

FIELD AND BACKGROUND OF THE INVENTION

The present invention relates to a device in which a bookrack moves vertically and horizontally.

The present invention is characterized by that it not only renews the conception of the bookrack but also enables books to be taken out or arranged from a seated condition by adopting a construction in which several book racks (80) are each attached to one of many moving bodies (35) such that each book rack moves vertically and horizontally together with the moving bodies (35).

Regarding the ordinary bookstand, several racks are attached to a depressed body like a box with the front open. In the case of large or tall bookcases, it is difficult for a child or for a handicapped person to take out or arrange books thereon. Physically handicapped persons in particular find it difficult to take out or arrange even those books at a low position.

Therefore, in order to take out or arrange those books at a high position, a chair, a table or a ladder must be used inconveniently. In order to take out or arrange those books at a low position, the body must be bent deeply.

Ordinary bookstands are simple and standardized in appearance, thereby making an indoor atmosphere prosaic. And, due to the above mentioned inconvenience of reaching the upper shelves, they cannot be manufactured so as to rise to a height of 10 meters or 20 meters.

For this reason, the present invention provides a bookstand which not only renews the conception of the bookstand but also enables those books at a high position or at a low position to be taken out or arranged from a seated position.

SUMMARY OF THE INVENTION

The present invention relates to a device in which a bookrack moves vertically and horizontally.

A bookrack is provided which renews the conception of the bookrack but also enables those books at a high position or at a low position to be taken out or arranged in a seated posture.

DESCRIPTION OF THE PREFERRED EMBODIMENT

Figure 1:
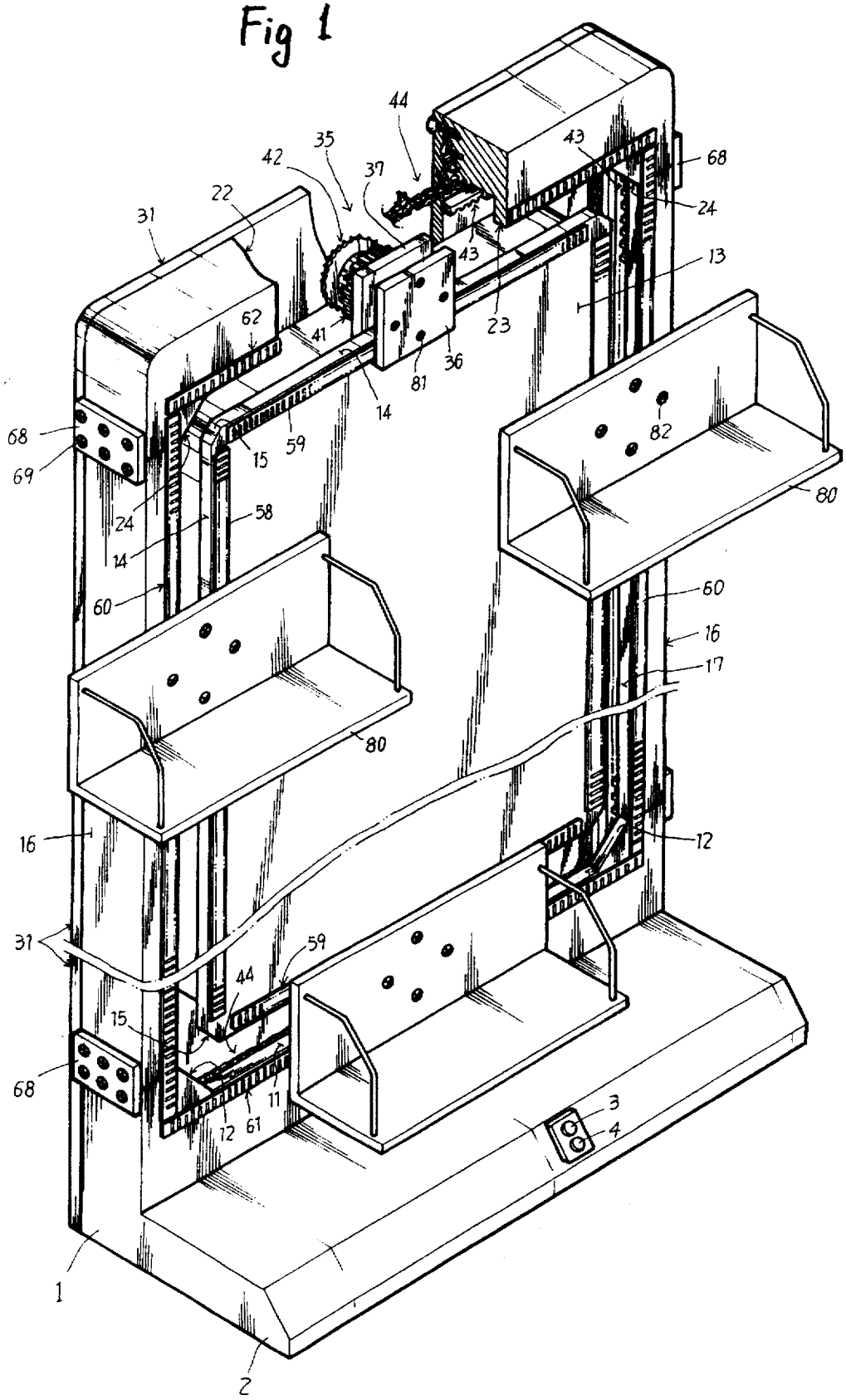
FIG. 1 is a perspective view of the present invention.
Figure 2A:
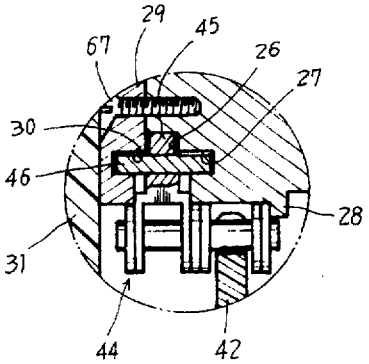
FIG. 2A is an enlarged view of section A of FIG. 2.
Figure 2:
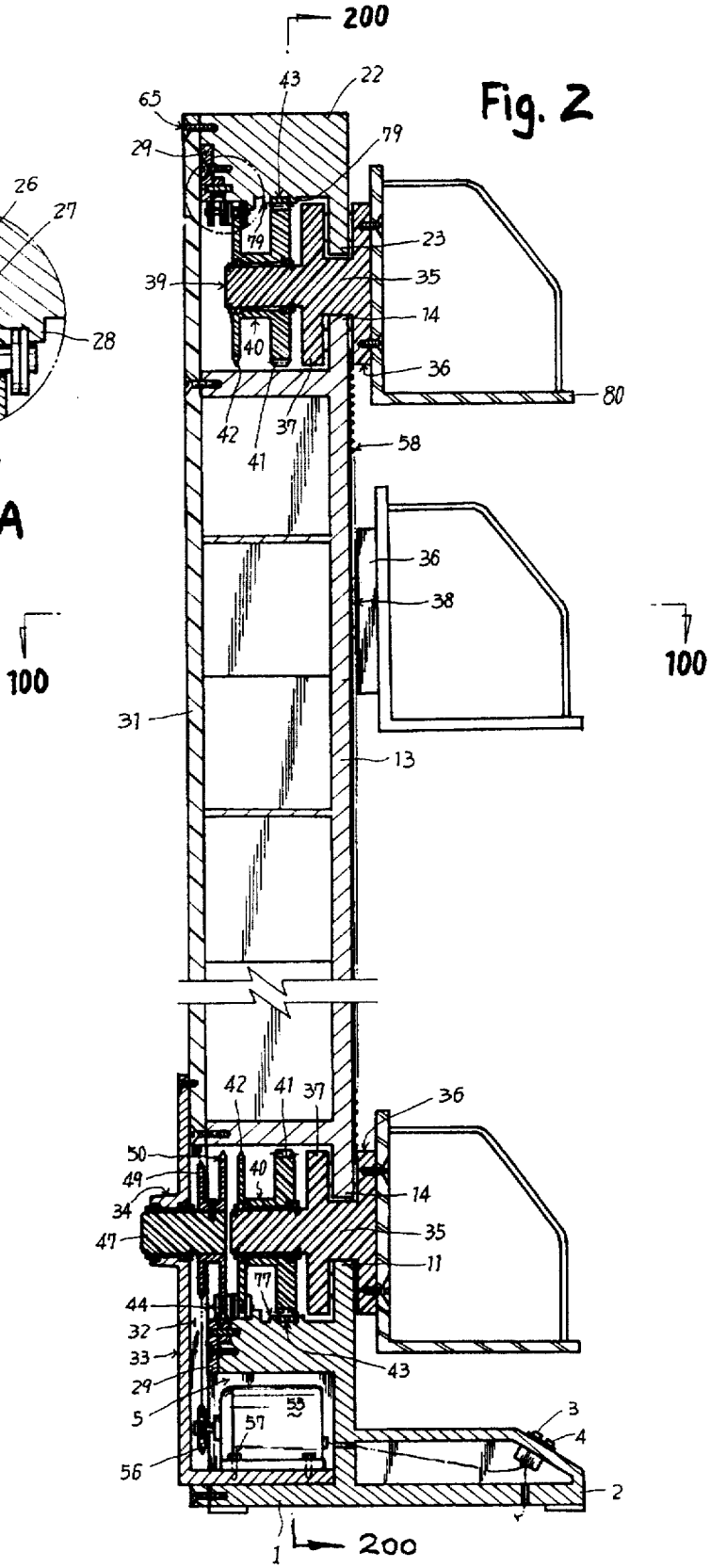
FIG. 2 is a sectional view of a bookrack of the invention.
Figure 3:
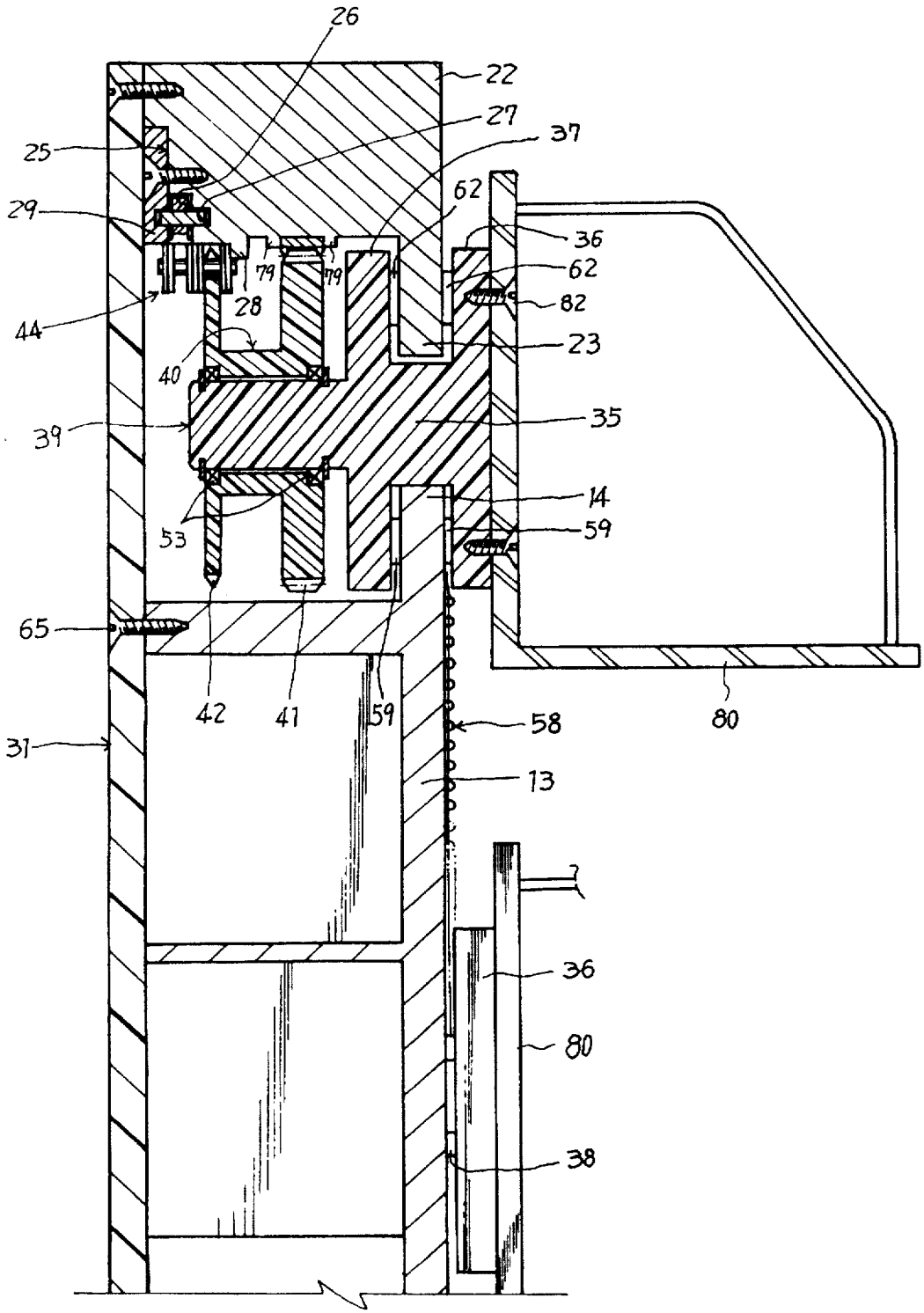
FIG. 3 is a sectional view of the bookrack.
Figure 4:
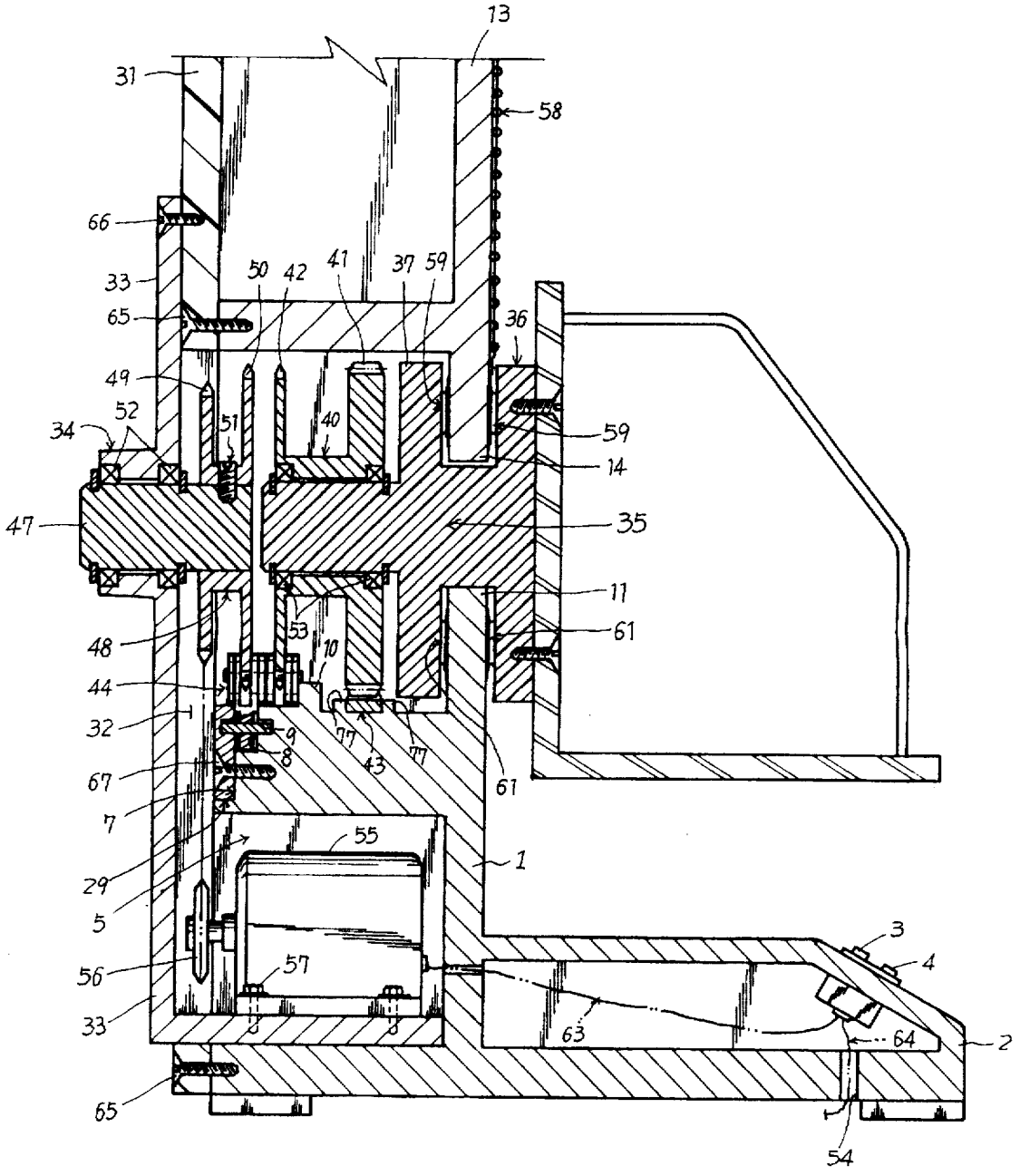
FIG. 4 is a partial sectional view of the bookrack.
Figure 5:
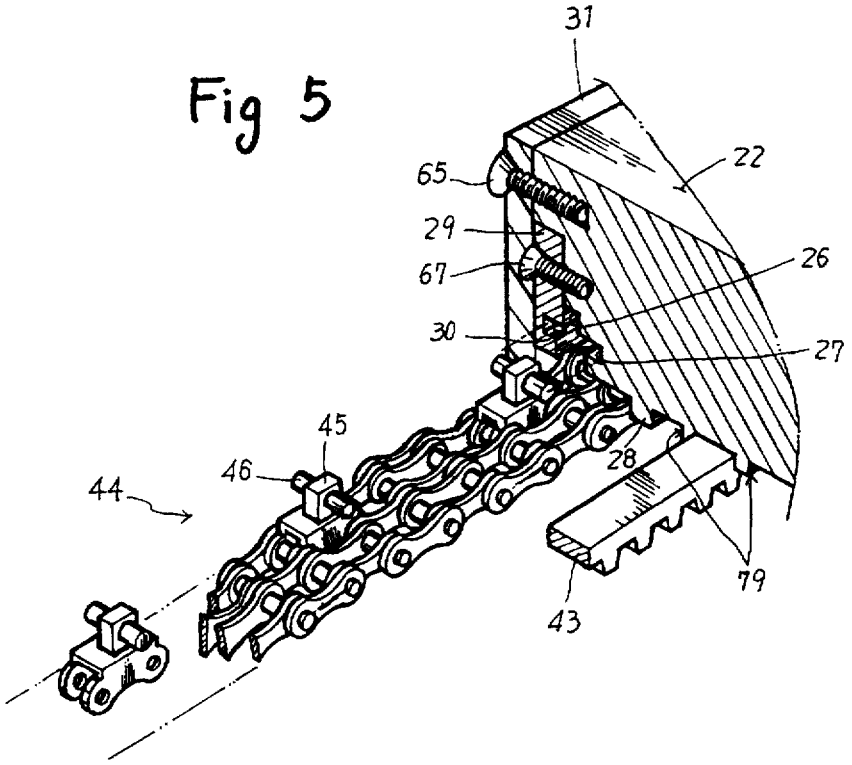
FIG. 5 is a reference perspective view showing a part of the present invention.
Figure 7:
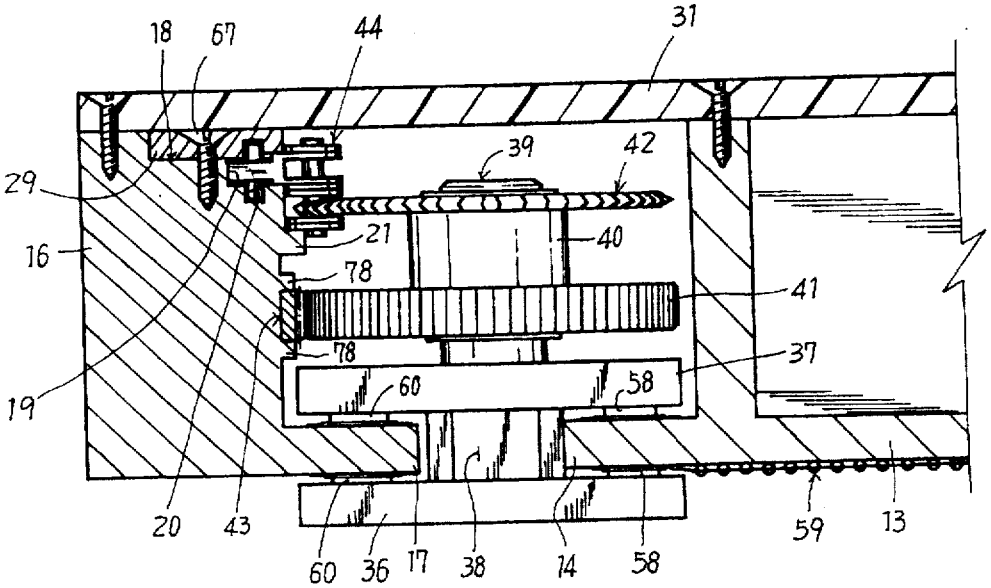
FIG. 7 is a partial sectional view of the bookrack.
Figure 6:
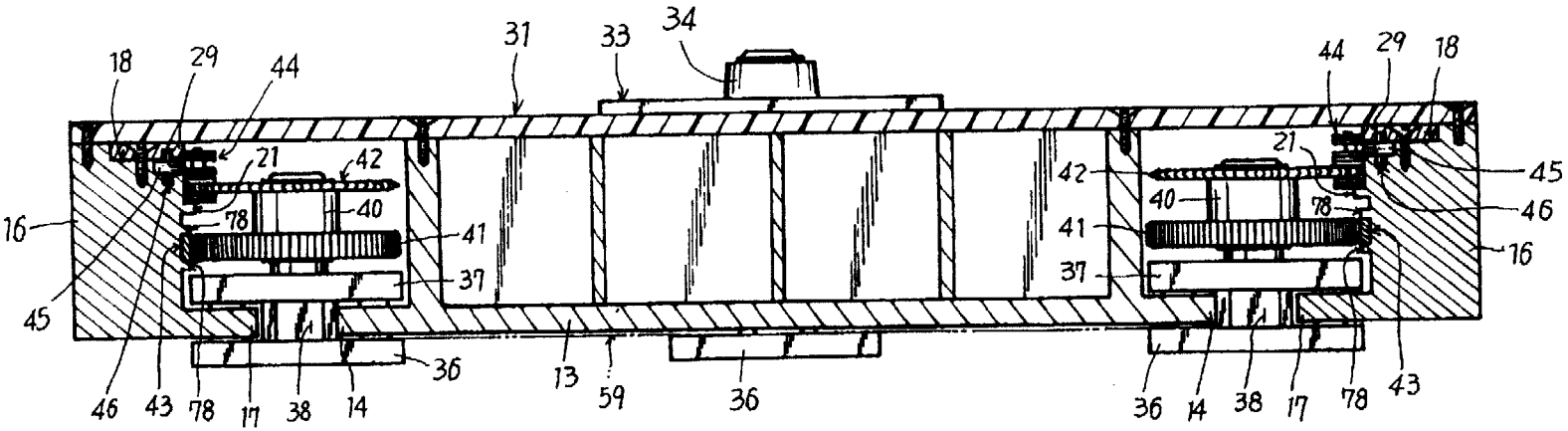
FIG. 6 is a sectional view taken along line 100—100 of FIG. 2.

In the bookrack of the invention, vertical frames (16) are located on the left and right of a base frame (1), an upper frame (22) is attached to the vertical frame (16) and a central frame (13) is located in the middle of those frames (1)(16)(22). These frames (1)(13)(16)(22) are fixed with a rear cover (31) and reinforcing strips (68) with fasteners (69). A projecting step (2) may be provided attached to base frame (1) for stability. At this time, a moving body guide (14) located in the top and bottom and both sides of the central frame (13) is inset between square plates (36)(37) of a moving body (35). In this case, the number of moving bodies (35) will be properly determined according to the size of the bookrack and the size of a bookrack (80). In other words, the bookrack (80) must not interfere with each other when they move; and so the proper number is determined according to the size of the present invention. When a proper number of moving bodies (35) are set up on the moving body guide (14), a rack gear (43) provided in communication with the moving bodies (35). The lower end of the rack gear (43) is inset in a rack gear inserting jaw (77) of the base frame (1). In this manner, the base frame (1) and the central frame (13) are positioned accurately and a gear (41) of the moving body (35) engages with the rack gear (43).

The vertical frame (16) and upper frame (22) are also provided with the rack gear (43) inset in a rack gear inserting jaw (78).

Figure 8:
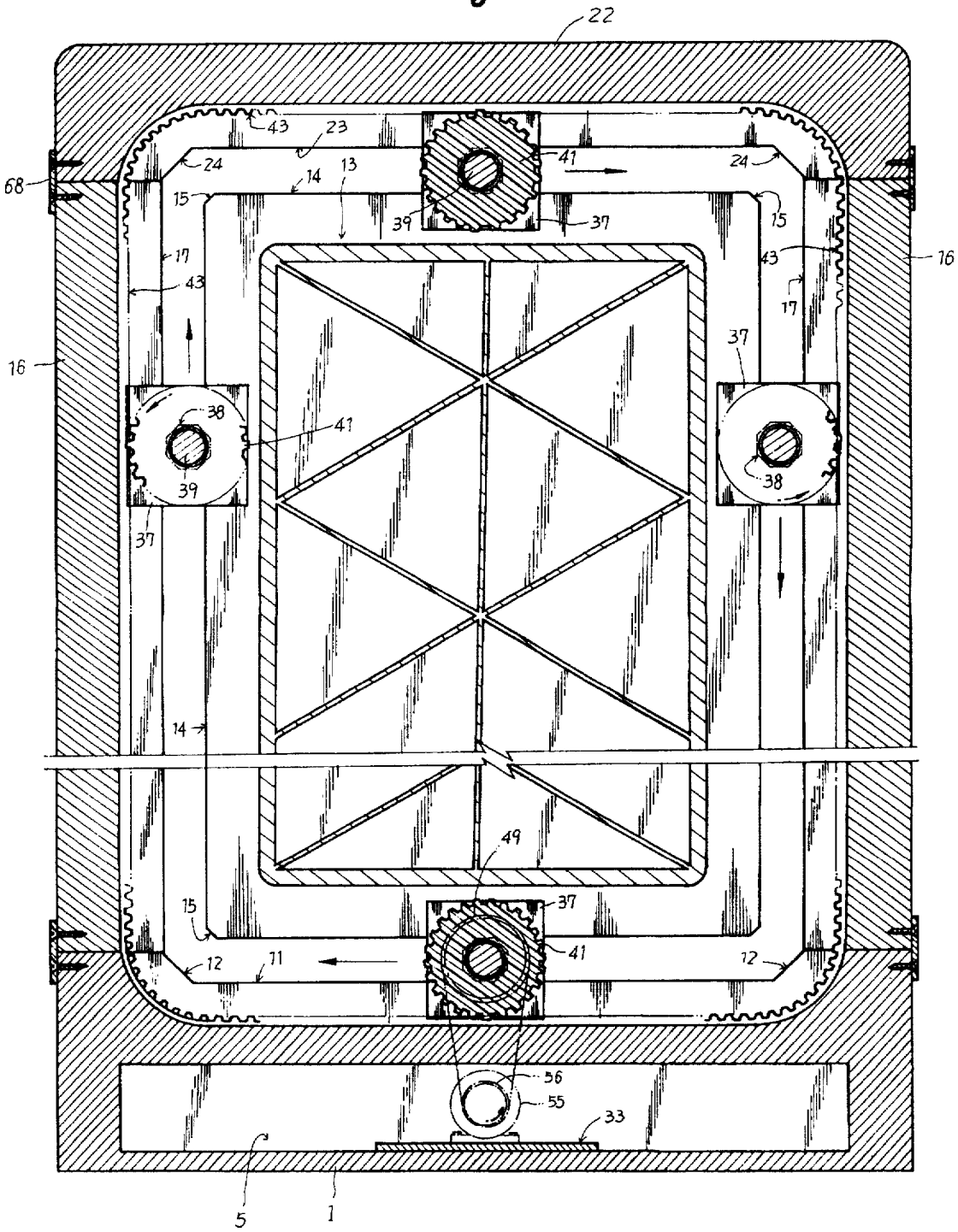
FIG. 8 is a sectional view taken along the line 200—200 of FIG. 2.

Next, the upper frame (22) is fixed up. In such a condition, the base frame (1), the vertical frame (16), the upper frame (16) and the central frame (13) are thus oriented with the moving body (35) between them as seen in FIG. 8.

Consequently, an octagonal axis (38) of the moving body (35) is located between moving body guides (11)(14)(17)(23) and the inner sides of the square plates (36)(37) come into contact with linear bearings (58)(59)(60)(61)(62). The linear bearings (58)(59)(60)(61)(62) not only enable the square plates (36)(37) to slide easily when the moving body (35) moves but also reduce power consumption by lowering the coefficient of friction. It is desirable that the space between the base frame (1) and the vertical frame (16) and the space between the moving body guides (11)(17)(23) of the upper frame (22) and the moving body guide (14) of the central frame (13) are larger than the width of the octagonal axis (38) of the moving body (35), but a tolerance of less than 0.3 m/m is good. Since the width of the octagonal axis (38) is the same as the length, it is referred to here as the width.

Figure 9:
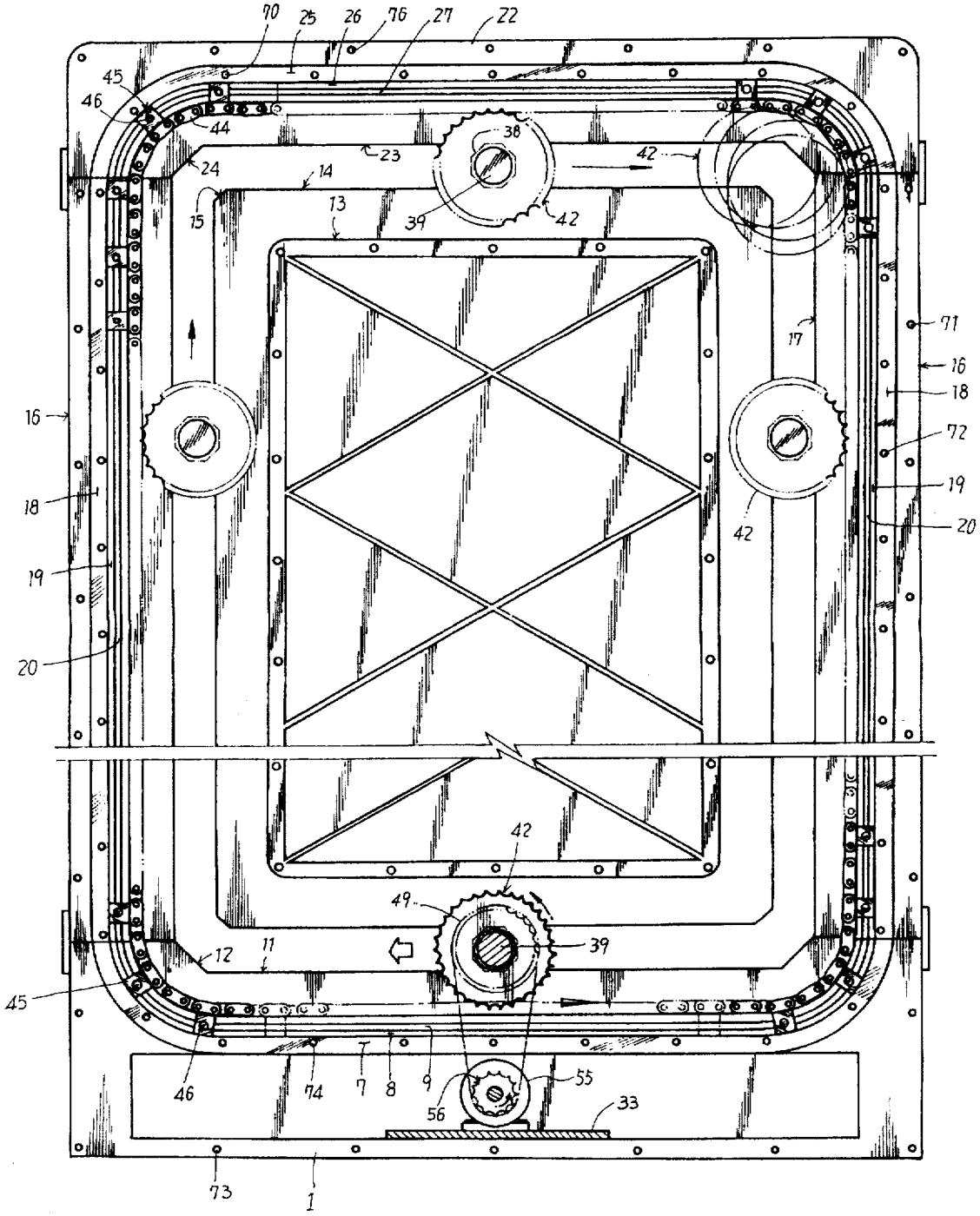
FIG. 9 is a rear view of the bookrack with some cutaway portions.

An attachment double chain (44) is provided within the base frame (1), the vertical frame (16), the upper frame (22) and the central frame (13). A pin (46) is inserted into each pin moving groove (9)(20)(27) and an inner chain is brought into contact with double chain contact jaws (16)(21)(28). The inner chain is engaged with a chain gear (42) of the moving body (35) as seen in FIG. 9.

Figure 10:
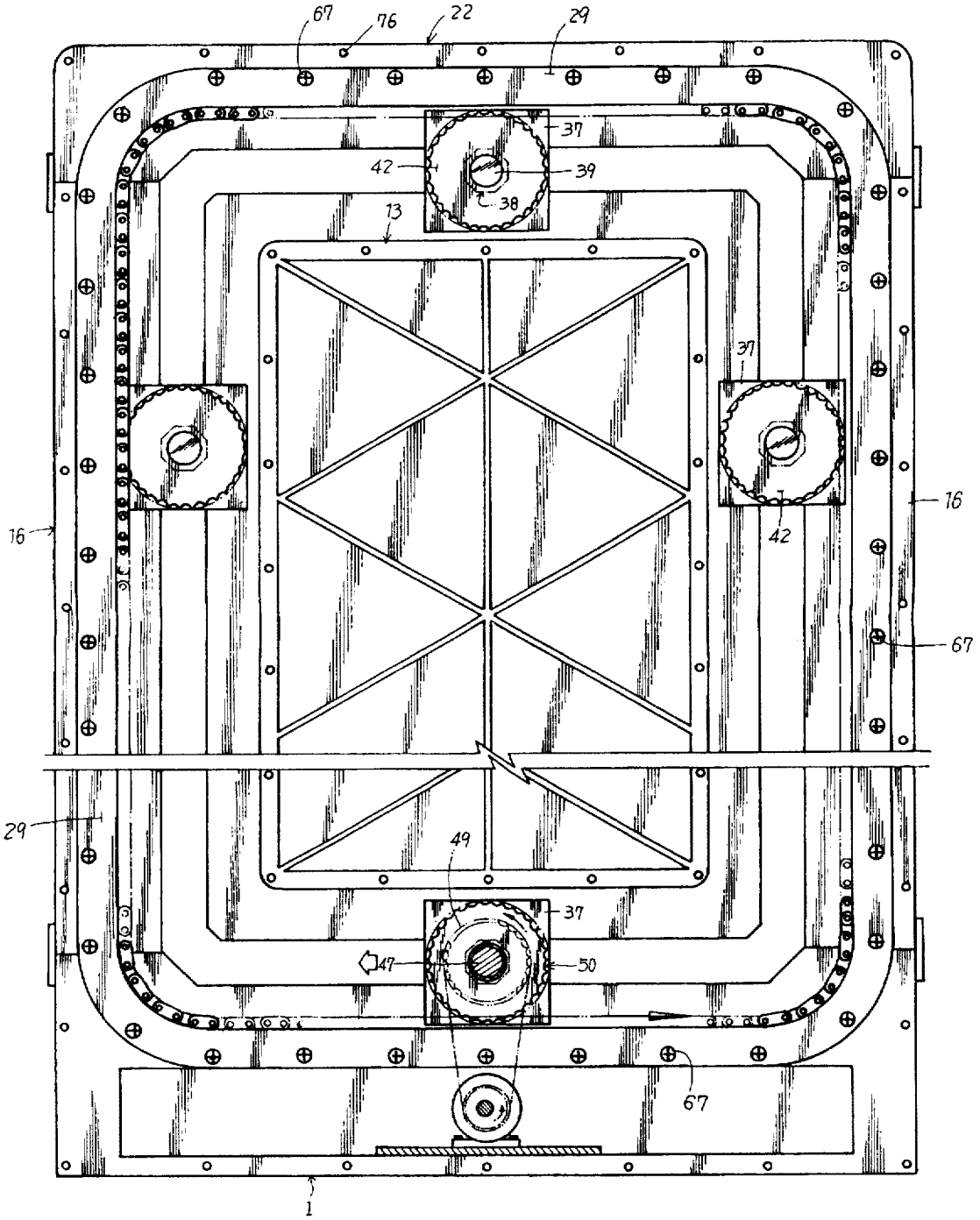
FIG. 10 is a rear view of the bookrack with some cutaway portions.
Figure 11:
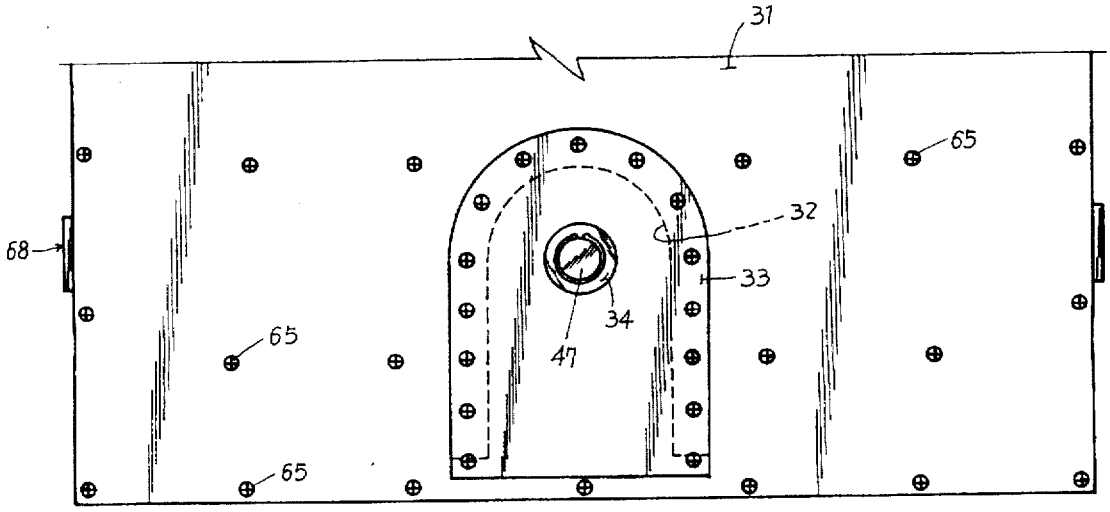
FIG. 11 is a reference view showing only the lower part of the rear when the present invention is assembled.

A pin moving groove (30) is covered with a chain cover (29) formed in the inside and attached with a screw (67). A pin (46) is inserted into the pin moving groove (30) as shown in FIG. 10. The bookrack is completed with the exception of a power transmission system.

The power transmission system will be described.

A rotary wheel (48) and a reduction motor (55) are positioned on an axis (47) of a bracket (33) and two chain gears (49)(50) are formed in the rotary wheel (48). The bracket (33) is held in a rear cover (31) with a screw (66).

A hole (32) in the rear cover (31) is formed to enable the rotary wheel (48) and the reduction motor (55) to pass therethrough. After the bracket (33) is positioned in the rear cover (31), a chain connected between a chain gear (56) of the reduction motor (55) and a chain gear (49) of the rotary wheel (48).

A second chain gear (50) of the rotary wheel (48) is engaged with an outer chain of the attachment double chain (44). This connection is very important in the power transmission system of the bookcase.

To close the rear cover (31) lastly, a screw (65) is used. When the rear cover (31) is closed, the frames (1)(13)(16) are united in a body. Of course, the central frame (13) stays in the middle formed by the base frame (1), the vertical frame (16) and the upper frame (22). The reinforcing metal (68) is attached to fix up each frame more firmly in a preferred embodiment.

Since a screw hole (81) is formed in the square plate (36) on the outer side of the moving body (35), a bookrack (80) can be easily attached with a screw (82). However, the method of attaching the bookrack (80) can be by any known means.

In use, when power is provided to the reduction motor (55), the vertical frame (16) can be raised to a height of 10 meters, 20 meters or more and controlled operation is also possible. The operation switches (3)(4) are at user's option in selecting regular or inverse rotation of the reduction motor (55). However, it is desirable and economical to place the operation switch on a side of the bookrack (80) on which books one intends to read or arrange are put. When the operation switch is operated, the reduction motor (55) operates and the chain gear (56) turns round. As the rotary wheel (48) of the bracket (33) turns round according to the rotation of the chain gear (56), a chain gear (50) engaged with the outer chain of the attachment double chain (44) turns round and the attachment double chain (44) moves accordingly.

The attachment double chain (44) moves in the direction of an arrow as the pin (46) is inserted into pin moving grooves (9)(20)(27)(30) as illustrated in FIG. 9. When the attachment double chain (44) moves, a rotary wheel (40) of the moving body (35) turns round as a result. Accordingly, a gear of the rotary wheel (40) turns round riding on a rack gear (43) and moves in a direction contrary to the attachment double chain (44). According to such working, the moving body (35) can move freely.

An inclined plane (15) formed at the four corners of the central frame (13) and inclined planes (24)(12) formed on both sides of the upper frame (22) and base frame (1) are formed so as to enable the octagonal axis of the moving body (35) to achieve cornering without strain. When the octagonal axis (38) corners, it slides on those inclined planes (15)(24)(12), and so it can horizontally corner without strain. For this reason, the octagonal axis (38) is selected.

The octagonal axis (38) slides on the inclined planes (15)(24)(12) by an inclined plane formed therein, and so the bookrack (80) can move horizontally. It is preferably keep the space between the inclined planes (15)(24)(12) larger than the width of the octagonal axis (38). This tolerance elastically accommodates an error caused between a cornering track formed by the center of the gear (41) when it turns round and a cornering track formed by the center of the octagonal axis (38) when it corners.

However, the error caused between the cornering track formed by the center of the gear (41) when it turns round and the cornering track formed by the center of the octagonal axis (38) when it corners is not so great so as to cause a problem in operating the present invention.

The dimensions used in a preferred embodiment are:

Diameter of gear (41): 100 m/m

Width of octagonal Axis (38): 40 m/m

The maximum difference between a cornering track formed by the center of the gear (41) and a cornering track formed by the center of the octagonal axis (38) was about 4 m/m. There was no problem in the cornering of the octagonal axis (38) when the space between those inclined planes (15)(24)(12) was made larger about 4 m/m than the width of the octagonal axis (38) and the octagonal axis (38) slid down horizontally on the inclined plane (15). In this case, it was found that there was no problem in operation even when the space between those inclined planes (15)(24)(12) was made larger only about 3 m/m than the width of the octagonal axis (38). Since the rotary wheel (40), mounted in a circular axis (39) of the moving body (35), turns round and move the moving body (35) in a horizontal or vertical direction, the bookrack (80) attached to the moving body (35) moves its position horizontally together with the moving body (35).

The bookrack (80) changes position freely as the moving body (35) moves horizontally or vertically. The bookrack (80) is kept horizontal at any position. It has the effect of enabling a child, an old and infirm person or a physically handicapped person to take out or arrange those books placed at a high position from a seated posture.

In the case where the bookrack of the invention is used, it is not necessary to use a chair, a table or a ladder and there is no danger of an accident from falling.

The bookrack can be installed on a table when made small in size. If made small, it can be operated manually.

If circumstances require, the present invention can be made tall. In this case, a large number of bookracks (80) can be attached.

Moreover, the present invention is not confined only to the range of its use as a bookrack. It can be used as a display stand of various articles or curios, as a stand for keeping toys and vessels and as an industrial apparatus.

What is claimed is:

1. A device in which a bookrack moves vertically and horizontally, comprising:

a base frame having a projecting step on which operation switches are mounted;

a pair of vertical frames attached to each of the left and right sides of the base frame;

an upper frame connecting the top ends of the pair of vertical frames, the upper frame, pair of vertical frames and base frame forming an outer frame;

a central frame positioned within the outer frame and secured to the outer frame by a rear cover and reinforcing strips;

a moving body guide formed in the outer frame having inclined planes at an angle of 45° at the corners of the moving body guide, a rack gear insertion jaw and a double-chain contact jaw formed at the rear of the moving body guide, a step provided with a pin support metal contact step, a pin moving groove and fastening means for securing to the back of the moving body guide, and linear bearings attached to the front and rear of the moving body guide;

an inner moving body guide formed on the center frame having inclined planes at an angle of 45° at each corner and linear friction bearings attached to the front and rear of the inner moving body guide;

a rack gear within the rack gear mounting jaw, each of the corners of the rack gear forming a circular arc;

an attachment double chain having inner and outer chains provided with a pin and a pin support, the pin positioned within and movable through the pin moving groove in the outer frame;

a chain cover attached to the outer frame having an inner pin moving grove formed on the inner side, and the four corners each forming a circular arc;

housing means within the base frame for containing a bracket on which a reduction motor having a motor chain gear is mounted, the motor being operated by the operation switches, and a rotary wheel having a wheel axis mounted in a boss having a bearing in the bracket, the rotary wheel having a first wheel chain gear connected to the motor chain gear by a drive chain and a coaxial second wheel chain gear having the same number of teeth as the first wheel chain gear, the rotary mounted such that the second wheel chain gear is in communication with the outer chain of the attachment double chain;

a moving body having an octagonal axis formed between a pair of square plates, the octagonal axis oriented between the moving body guide and the inner moving body guide, the moving body further having a circular axis connected to one of the square plates within the outer frame, a body rotary wheel rotatably mounted on the circular axis having a body chain gear with the same number of teeth as the first chain wheel gear in communication with the inner chain of the attachment double chain, and a second body gear in communication with the rack gear;

a bookrack attached to the other of the square plates on the outside of the outer frame, whereby, when the motor is operated by the operation switches, the motor chain gear rotates, causing the first wheel chain gear to rotate, thereby driving the second wheel chain gear and moving the attachment double chain, such that the movement of the inner chain of the double attachment chain causes the body rotary wheel to turn, and the second body gear drives the moving body and bookrack on the octagonal axis between the moving body guides by interaction with the rack gear, the bookrack maintaining a horizontal position during the horizontal and vertical movement of the octagonal axis.

* * * * *